US011132978B2

(12) United States Patent
Lee et al.

(10) Patent No.: US 11,132,978 B2
(45) Date of Patent: Sep. 28, 2021

(54) GAMMA CORRECTION CIRCUIT, METHOD FOR GAMMA CORRECTION, AND DISPLAY DEVICE INCLUDING GAMMA CORRECTION CIRCUIT

(71) Applicant: Magnachip Semiconductor, Ltd., Cheongju-si (KR)

(72) Inventors: Myung Woo Lee, Seongnam-si (KR); Hee Sung Yang, Seoul (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 16/832,013

(22) Filed: Mar. 27, 2020

(65) Prior Publication Data

US 2020/0394981 A1 Dec. 17, 2020

(30) Foreign Application Priority Data

Jun. 12, 2019 (KR) ..... 10-2019-0069326

(51) Int. Cl.

| | |
|---|---|
| ***G09G 5/10*** | (2006.01) |
| ***G09G 3/20*** | (2006.01) |
| ***G09G 3/32*** | (2016.01) |

(52) U.S. Cl.

CPC ..... *G09G 5/10* (2013.01); *G09G 3/2007* (2013.01); *G09G 3/32* (2013.01); *G09G 2310/08* (2013.01); *G09G 2320/0276* (2013.01)

(58) Field of Classification Search

None

See application file for complete search history.

(56) References Cited

U.S. PATENT DOCUMENTS

| | | | | |
|---|---|---|---|---|
| 8,854,294 | B2 | 10/2014 | Sakariya | |
| 2004/0090409 | A1* | 5/2004 | Nakata | G09G 3/3696 345/89 |
| 2006/0033695 | A1* | 2/2006 | Kudo | G09G 3/3607 345/89 |
| 2006/0087483 | A1* | 4/2006 | Takada | G09G 3/3688 345/89 |
| 2010/0103315 | A1* | 4/2010 | Li | G09G 3/3688 348/500 |

* cited by examiner

*Primary Examiner* — Matthew Yeung

(74) *Attorney, Agent, or Firm* — NSIP Law

(57) ABSTRACT

A gamma correction circuit includes an input circuit configured to sequentially receive gamma control signals used for selecting gamma tap points from a control circuit through a single transmission line, and to output the received gamma control signals, and a voltage generator configured to select the gamma tap points based on the gamma control signals, and to generate gamma voltages according to the gamma tap points.

17 Claims, 8 Drawing Sheets

GAMMA CORRECTION CIRCUIT, METHOD FOR GAMMA CORRECTION, AND DISPLAY DEVICE INCLUDING GAMMA CORRECTION CIRCUIT

CROSS-REFERENCE TO RELATED APPLICATIONS

This application claims the benefit under 35 USC 119(a) of Korean Patent Application No. 10-2019-0069326 filed Jun. 12, 2019 in the Korean Intellectual Property Office, the entire disclosure of which is incorporated herein by reference for all purposes.

BACKGROUND

1. Field

The following description relates to a gamma correction circuit. The following description also relates to a method for gamma correction. The following description also relates to a display device including the gamma correction circuit.

2. Description of Related Art

Generally, human vision reacts nonlinearly to brightness according to Weber's law. Accordingly, when changes in brightness of light are linearly recorded in an environment where representing information is limited, posterization may occur. Thus, a user may feel disconnected rather than smooth when brightness changes in the dark tones because the human eyes may respond sensitively. Accordingly, in a display device, it may be necessary to record image data of the dark tones in greater detail by non-linearly encoding input image data. The above process may be referred to as gamma correction, and a curve representing such a non-linear relation is may be referred to a gamma curve.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a gamma correction circuit includes an input circuit configured to sequentially receive gamma control signals used for selecting gamma tap points from a control circuit through a single transmission line, and to output the received gamma control signals, and a voltage generator configured to select the gamma tap points based on the gamma control signals, and to generate gamma voltages according to the gamma tap points.

The input circuit may include a buffer configured to receive the gamma control signals transmitted through the single transmission line, latches respectively configured to latch the gamma control signals, and to respectively output the latched gamma control signals into the voltage generator, and a switch circuit configured to output the gamma control signals from the buffer into the respective latches.

The switch circuit may include switches, wherein the switches may be turned on in response to receiving switching signals, so that the gamma control signals received in the buffer may be output, respectively, by the latches.

The input circuit may further include a switching signal generator configured to generate the switching signals for turning on the switches, and to sequentially transmit the switching signals into the respective switches.

The switching signal generator may include output circuits configured to sequentially output the switching signals, wherein at least one of the output circuits may be used by a level shifter.

The latches may be configured to respectively output the latched control signals, in a parallel manner, to the voltage generator in response to receiving a latch control signal.

The voltage generator may be configured to select the gamma tap points that become references of the gamma correction based on the gamma control signals, to determine reference gamma voltages for the respective gamma tap points, and to generate the gamma voltages by using the reference gamma voltages.

The voltage generator may include a resistor string comprising nodes corresponding to the respective gamma tap points, and may be configured to generate the gamma voltages by using voltages output from the respective nodes for the respective reference gamma voltages.

The voltage generator may be configured to determine positions of the respective nodes in the resistor string by using the received gamma control signals, and to generate the gamma voltages by using reference gamma voltages output from the respective determined nodes.

In another general aspect a gamma correction circuit includes an input circuit configured to sequentially receive M gamma control signals used for selecting M gamma tap points from a control circuit through a single transmission line, M being a natural number equal to or greater than 2, and to respectively output the M gamma control signals through M transmission lines; and a voltage generator configured to generate gamma voltages on the basis of the M gamma control signals.

The input circuit may include a buffer configured to receive the M gamma control signals transmitted through the single transmission line, a switch circuit configured to output the respective M gamma control signals through the M transmission lines, and M latches configured to respectively latch the M gamma control signals transmitted through the switch circuit, and to respectively output the M latched gamma control signals into the voltage generator.

The switch circuit may include M switches respectively connected to the M latches, wherein the respective M switches may be configured to be turned on in response to switching signals so that the M gamma control signals received in the buffer may be output into the respective M latches.

The M latches may be configured to respectively output the M latched gamma control signals in a parallel manner into the voltage generator, in response to receiving a latch control signal.

The voltage generator may be configured to select the M gamma tap points that become references of the gamma correction based on the M gamma control signals, to determine M reference gamma voltages for the M gamma tap points, and to generate the gamma voltages by using the M reference gamma voltages.

In another general aspect, a gamma correction method includes sequentially receiving gamma control signals used for selecting gamma tap points through a single transmission line, outputting, in a parallel manner, the sequentially received gamma control signals through lines differing from each other, and generating gamma voltages on the basis of the outputted gamma control signals.

The outputting in a parallel manner of the sequentially received gamma control signals may include respectively latching the sequentially received gamma control signals, and outputting, in a parallel manner, the latched gamma control signals.

Receiving timings of the respective gamma control signals may be different from each other, and output timings of the respective gamma control signals may be identical to each other.

In another general aspect, a gamma correction method includes sequentially receiving M gamma control signals used for selecting M gamma tap points from a control circuit through a single transmission line, M being a natural number equal to or greater than 2, and respectively outputting the M gamma control signals through M transmission lines, and generating gamma voltages on the basis of the M gamma control signals.

The respectively outputting the M gamma control signals through M transmission lines may include respectively latching the sequentially received gamma control signals, and outputting the latched gamma control signals into the voltage generator.

Receiving timings of the M gamma control signals may be different from each other, and output timings of the M gamma control signals may be identical to each other.

The latching may be performed by latches in response to the latches receiving a latch control signal.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
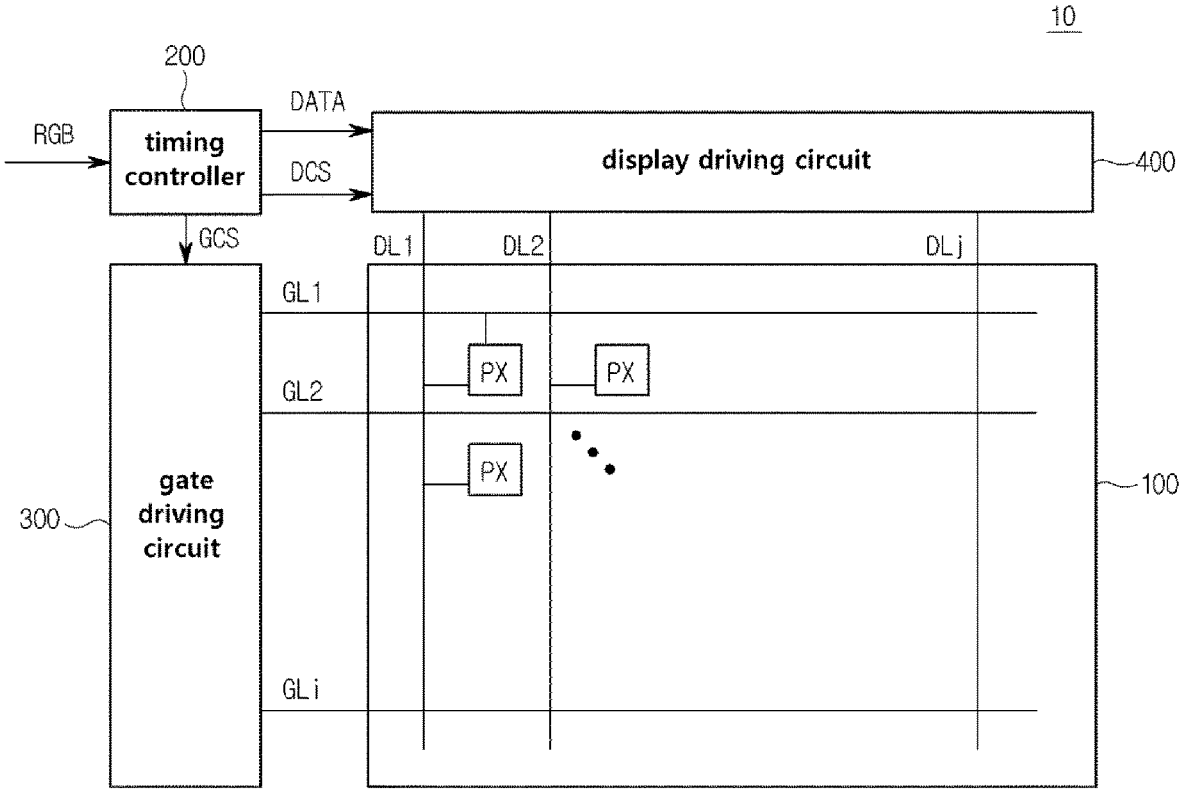
FIG. 1 is a view showing a display device according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Herein, it is noted that use of the term "may" with respect to an example or embodiment, e.g., as to what an example or embodiment may include or implement, means that at least one example or embodiment exists where such a feature is included or implemented while all examples and embodiments are not limited thereto.

For the above gamma correction, reference points, that is, gamma tap points, for performing gamma correction on a display device may be controlled. Such reference points may represent points on the gamma curve, and thus the gamma curve may be represented by using these points. In other words, the gamma tap points may represent a relation between a gray level and a voltage according to a specific gamma curve.

Meanwhile, when a number of the above points increases, gamma correction may be performed precisely, but a number of transmission lines for controlling the references points may increase.

Accordingly, the examples have been made keeping in mind the above issues occurring in the typical approaches, and an objective of the present examples is to provide a gamma correction circuit, a method with gamma correction, and a display device including the gamma correction circuit. Particularly, the examples are to provide a gamma correction circuit, a method with gamma correction, and a display device including the gamma correction circuit, where a performance in gamma correction may be improved and circuit complexity may be reduced.

According to an example, complexity in the gamma correction circuit may be reduced by receiving control signals for determining gamma voltages through a single transmission line.

FIG. 1 is a view showing a display device according to an example. Referring to the example of FIG. 1, a display device 10 may include a display panel 100, a timing controller 200, a gate driving circuit 300, and a display driving circuit 400. However, this is a non-limiting example, and the display device 10 may include other elements in addition to and/or instead of these enumerated elements.

According to examples, the display device 10 may be a device capable of displaying an image and/or a video. For example, the display device 10 may refer to a smartphone, a tablet personal computer, a mobile phone, a video phone, an e-book reader, a computer, a camera, or a wearable device, as non-limiting examples, but the display device 10 is not limited to these enumerated examples and other devices that are capable of displaying an image and/or a video may be used as the display device 10 in other examples.

The display panel 100 may include multiple pixels PX arranged in rows and columns. For example, the display panel 100 may be employed in any one of a light emitting diode (LED) display, an organic LED (OLED) display, an active-matrix OLED (AMOLED) display, an electrochromic display (ECD), a digital mirror device (DMD), an actuated mirror device (AMD), a grating light valve (GLV), a plasma display panel (PDP), an electro luminescent display (ELD), and a vacuum fluorescent display (VFD), but the display panel 100 is not limited to these enumerated examples and other devices that are capable of displaying an image and/or a video with multiple pixels PX arranged in rows and columns may be used as the display panel 100 in other examples.

The display panel 100 may include a plurality of gate lines GL1 to GLi, where i is a natural number, arranged in rows. The display panel 100 may also include a plurality of data lines DL1 to DLj, where j is a natural number, arranged in columns, and sub-pixels PX formed in respective intersection points between the plurality of gate lines GL1 to GLi and the plurality of data lines DL1 to DLj. The display panel 100 may include a plurality of horizontal lines, wherein each single horizontal line is configured to have sub-pixels PX connected to a single gate line. During one horizontal period (1H), sub-pixels PX arranged in one horizontal line may be driven, and during a subsequent 1H horizontal period, sub-pixels arranged in another horizontal line may be driven, instead.

Each of the sub-pixels PX may include a light emitting diode (LED) and a diode driving circuit that independently drives the LED. Each diode driving circuit may be connected to one gate line and one data line. Each LED may be connected between the diode driving circuit and a power source voltage, for example, a ground voltage.

Each diode driving circuit may include a switching element, for example, a thin film transistor (TFT) element, connected to the gate lines GL1 to GLi. When the switching element is turned on by providing a gate-on signal to the appropriate gate line of the gate lines GL1 to GLi, the diode driving circuit may provide to the LED an image signal or pixel signal provided from the appropriate data line of DL1 to DLj connected to the diode driving circuit. The LED may output an optical signal in association with the image signal.

Each sub-pixel PX may be one of a red element R outputting red light, a green element G outputting green light, and a blue element B outputting blue light. In the display panel 100, the red element, the green element, and the blue element may be arranged according to various methods. According to various non-limiting examples, sub-pixels PX of the display panel 100 may be arranged in an order of R, G, B and G, or B, G, R and G in a repeating manner. For example, pixels PX of the display panel 100 may be arranged according to a RGB stripe structure or RGB Pentile structure, but pixel arrangements are not limited to these examples and other pixel color arrangements may be used in other examples.

The timing controller 200 may receive external video image data as an RGB signal including color information for pixels in the video images, and may perform processing on the video image data RGB and/or generate image data DATA by converting the video image data according to a structure of the display panel 100. The timing controller 200 may transmit the image data DATA to the display driving circuit 400. For example, the timing controller 200 may be also referred to as a control circuit.

The timing controller 200 may receive a plurality of control signals from an external host device. For example, the control signals may include a horizontal synchronization signal, a vertical synchronization signal, and an operation clock signal, but other control signals may be used in other examples.

The timing controller 200 may generate a gate control signal GCS, and a data control signal DCS for controlling the gate driving circuit 300 and the display driving circuit 400, respectively, based on the received control signals. The timing controller 200 may control various driving timings of the gate driving circuit 300 and the display driving 400 based on the gate control signal GCS and the data control signal DCS.

According to an example, the timing controller 200 may control the gate driving circuit 300 so that the gate driving circuit 300 provides gate-on signals to the plurality of gate lines GL1 to GLi based on the control signal GCS. The timing controller 200 may also control the display driving circuit 400 so that the display driving circuit 400 provides image signals to the plurality of datalines DL1 to DLj based on the data control signal DCS.

The gate driving circuit 300 may provide gate-on signals to the plurality of gate lines GL1 to GLi in sequence in response to a gate control signal GCS. For example, the gate control signal GCS may include a gate start pulse indicating a start of outputting the gate-on signals and also a gate shift clock controlling each timing of the gate-on signal.

When a gate start pulse is input, the gate driving circuit 300 may sequentially generate gate-on signals, for example, signals where the gate voltage is logically high, in response to signals of a gate shift clock, and may sequentially provide the generated gate-on signals to the plurality of gate lines GL1 to GLi. In such an example, during a period in which the gate-on signals are not provided to the plurality of gate lines GL1 to GLi, gate-off signals, for example, signals where the gate voltage is logically low, may be provided to the plurality of gate lines GL1 to GLi.

The display driving circuit 400 may convert the digital image data DATA to analog image signals in response to a data control signal DCS, and may then provide the resulting image signals to the plurality of data lines DL1 to DLj. The display driving circuit 400 may also provide image signals in association with one horizontal line to the respective plurality of data lines DL1 to DLj during a 1H horizontal time period.

Thus, each configuration of the display device 10 may be employed in a circuit capable of performing the corresponding function.

Figure 2:
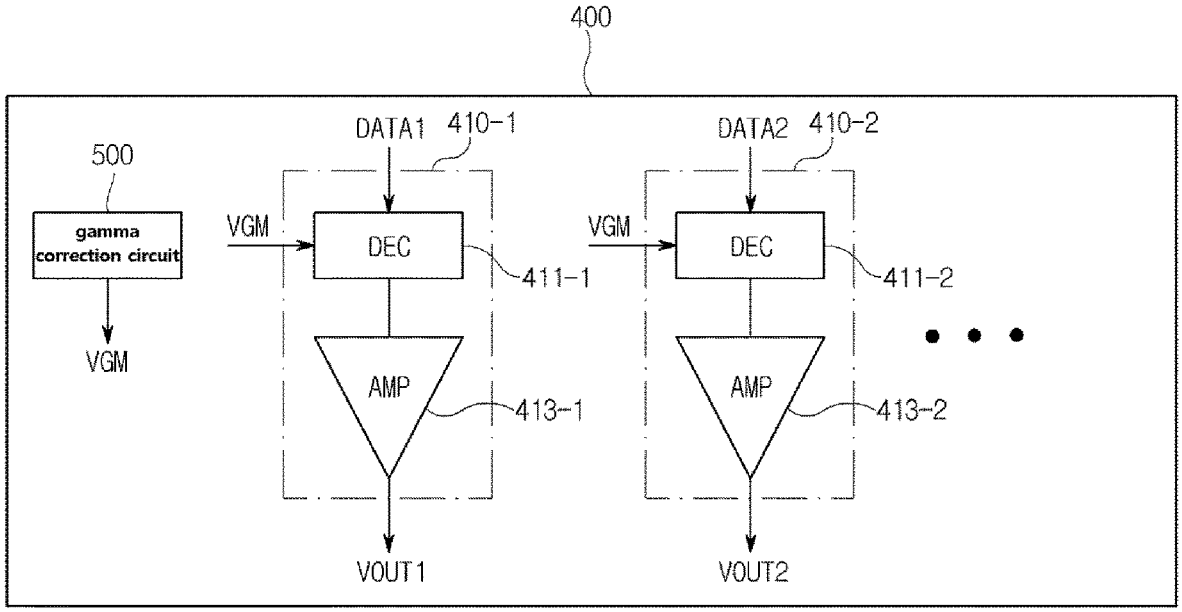
FIG. 2 is a view showing a display driving circuit according to an example.

FIG. 2 is a view showing a display driving circuit according to an example. Referring to the examples of FIGS. 1 and 2, the display driving circuit 400 may include a plurality of drivers 410-1, 410-2, . . . , and so on, and also a gamma correction circuit 500.

The drivers 410-1, 410-2, . . . may respectively receive image data DATA, may convert the image data, namely, DATA1, DATA2, . . . ; collectively, DATA, to image signals VOUT, and may output the image signals, namely, VOUT1, VOUT2, . . . ; collectively, VOUT, to the display panel 100. According to examples, the drivers 410-1, 410-2, . . . may output image signals VOUT to sub-pixels PX of the display panel 100.

Herein, the image data DATA may be digital data including red pixel data R, green pixel data G, and blue pixel data B, and the image signals VOUT may be analog values or voltages provided to the sub-pixels PX.

Although two drivers 410-1 and 410-2 are shown in the example of FIG. 2 as an example, the display driving circuit 400 may include at least three drivers, in general, and thus in non-limiting examples, there may also be three or more drivers.

The gamma correction circuit 500 may generate gamma voltages VGM used when converting image data DATA into image signals VOUT. In other words, the gamma correction circuit 500 may generate gamma voltages VGM used for performing gamma correction on image data. As the operation of the gamma correction circuit is described in further detail later, the gamma correction circuit 500 may generate gamma voltages VGM on the basis of a control signal transmitted from the control circuit, for example, timing controller 200, within the display device 10.

Gamma voltages VGM may correspond to grayscale levels of the display device 10. For example, when the display device 10 supports 256 grayscale levels, that is, based on 8 bits, gamma voltages VGM may include a first gamma voltage corresponding to a zero gray level to a 256-th gamma voltage corresponding to a 255-th grayscale level. According to examples, the gamma correction circuit 500 may select gamma tap points based on references from gray levels of the display device 10, and may generate gamma voltages VGM for respective gray levels by using respective reference gamma voltages in association with the selected gamma tap points.

According to an example, the gamma correction circuit 500 may include a resistor string for generating gamma voltages, and the gamma correction circuit 500 may generate gamma voltages VGM by dividing a power source voltage by using the resistor string. Each gamma tap point may refer to a node positioned in the resistor string, and the resulting voltage output from the node may become a reference gamma voltage for each gamma tap point. In other words, by changing a position of the gamma tap point, the voltage division ratio may be adjusted according to the resistor string. In other words, the voltage division ratio may be adjusted according to a position of the gamma tap point, and as a result, the reference gamma voltage may vary accordingly.

When image data DATA includes three types of pixel data, for example, R, G, and B data, the gamma correction circuit 500 may generate gamma voltages VGM for respective pixel types. For example, the gamma correction circuit 500 may generate gamma voltages used for gamma correction of R pixel data, gamma voltages used for gamma correction of G pixel data, and gamma voltages used for gamma correction of B pixel data.

According to an example, gamma voltages VGM for respective pixel types may be generated according to gamma features or gamma curves that differ from each other. However, gamma voltages are not limited to this particular non-limiting example, and gamma voltages VGM each may be generated according to the same gamma feature. For example, when gamma features different with each other are applied to respective pixel types, the gamma correction circuit 500 may select gamma tap points for respective pixel types, and generate reference gamma voltages for respective pixel types, accordingly. In, three types of gamma control signals may be used, in keeping with the three types of pixel data.

However, for convenience and simplicity of explanation, in the present disclosure, it is assumed that image data DATA refers to a specific pixel type. However, examples are not limited to using a specific pixel type and image data DATA need not be limited to a specific pixel type, in other examples.

The gamma correction circuit 500 may transmit gamma voltages VGM to the drivers 410-1, 410-2, . . . .

The drivers 410-1, 410-2, . . . may be identical in function and structure to one another, in a non-limiting example. Therefore, subsequently, description will be made on the basis of one driver 410-1, as the description applies similarly to the other drivers as they may share characteristics of description with driver 410-1.

For example, the driver 410-1 may include a decoder 411-1 and a source amplifier 413-1.

The decoder 411-1 may output a gamma voltage corresponding to input image data DATA, or pixel data, to the source amplifier 413-1. According to an example, the decoder 411-1 may receive gamma voltages VGM from the gamma correction circuit 500, and may output gamma voltages corresponding to input image data to the source amplifier 413-1 based on using the received gamma voltages VGM.

For example, the decoder 411-1 may receive gamma voltages, for example, R gamma voltages, G gamma voltages and B gamma voltages, respectively corresponding to R, G and B pixel data, and may output the gamma voltages corresponding to the input pixel data into the source amplifier 413-1.

The source amplifier 413-1 may then output the gamma voltage, that is, a gamma voltage corresponding to pixel data, output from the decoder 411-1 as an image signal VOUT1. According to a non-limiting example, the source amplifier 413-1 may generate an image signal VOUT1 by amplifying the gamma voltage output from the decoder 411-1, and may output the generated image signal VOUT1.

Image signals VOUT output from the drivers 410-1, 410-2, . . . may be represented in an image by being transferred to the display panel 100.

Figure 3:
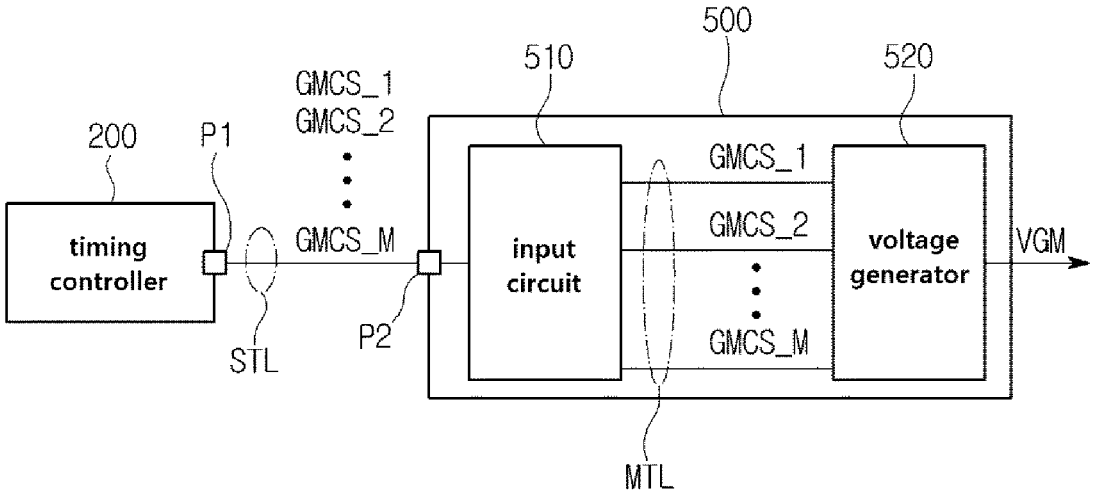
FIG. 3 is a view showing a timing controller and a gamma correction circuit according to an example.

FIG. 3 is a view showing a timing controller and a gamma correction circuit according to an example. Referring to the examples of FIGS. 1 to 3, the gamma correction circuit may output gamma voltages VGM. According to an example, output gamma voltages VGM may be used in the drivers 410-1, 410-2, . . . of the display driving circuit 400 by being transferred to the drivers 410-1, 410-2, . . . .

The gamma correction circuit 500 and the timing controller 200 may be connected in a single transmission line STL.

The gamma correction circuit 500 may receive gamma control signals GMCS_1 to GMCS_M from the timing controller 200, through the single transmission line STL. According to an example, the gamma correction circuit 500 may sequentially receive gamma control signals GMCS_1 to GMCS_M through the single transmission line STL, but this is only a non-limiting example, and other examples may use different orderings.

The gamma control signals GMCS_1 to GMCS_M may be signals used for generating gamma voltages VGM. According to an example, each of the gamma control signals GMCS_1 to GMCS_M may be a signal used for selecting or determining a gamma tap point. As described above in further detail, gamma tap points may mean points that become references used for generating gamma voltages according to a gamma feature or gamma curve, and thus the gamma control signals GMCS_1 to GMCS_M may each mean or denote one gamma feature or gamma curve.

According to an example, each of the gamma control signals GMCS_1 to GMCS_M may be a signal of N bits, where N is a natural number equal to or greater than 1, and the display device 10 may support gray levels of $2^N$ in number. For example, when the display device 10 supports 256 gray levels, N may be 8.

According to an example, when the gamma correction circuit 500 may generate reference gamma voltages corresponding to gamma points by using the resistor string where the gamma tap points are positioned, the gamma control signals GMCS_1 to GMCS_M may also be signals used for changing the gamma tap points in position in the resistor string. In other words, the reference gamma voltages may be changed by being divided by the resistor string according to the gamma control signals GMCS_1 to GMCS_M. For example, the gamma control signals GMCS_1 to GMCS_M may be signals used for controlling switches.

According to examples, a number of the gamma control signals GMCS_1 to GMCS_M and a number of gamma tap points may be identical, for example, M. Herein, M may be determined such that $2^M$ becomes equal to or smaller than a number of gray levels of the display device 10. For example, when the display device 10 supports 256 gray levels, M may be a natural number equal to or smaller than 8.

In addition, according to examples, when image data DATA includes three types of pixel data, for example, R, G and B, gamma control signals GMCS_1 to GMCS_M may be present for each pixel type. In other words, the timing controller 200 may transmit control signals used for selecting gamma tap points of respective R, G and B pixel data, and the gamma correction circuit 500 may generate gamma voltages for the respective R, G and B pixel data on the basis of the control signals of the respective R, G and B pixel data, accordingly.

In such an example, control signals of the respective R, G and B pixel data may be respectively transmitted through separate single transmission lines.

When each of the gamma control signals GMCS_1 to GMCS_M is a signal of N bits, where N is a natural number equal to or greater than 1, the gamma control signals GMCS_1 to GMCS_M may be sequentially transmitted to the gamma correction circuit 500 through the single transmission line STL one by one. In other words, data may be sequentially transmitted on the basis of N-bits through the single transmission line STL, on a one by one basis.

According to an example, the timing controller 200 may include a pin P1 or pad connected to the single transmission line STL, and the gamma correction circuit 500 may include a pin P2 or pad connected to the single transmission line STL. The pins/pads P1 and P2 are dedicated for the use in the single transmission line STL.

The gamma correction circuit 500 may include an input circuit 510 and a voltage generator 520, in a non-limiting example.

The input circuit 510 may receive gamma control signals GMCS_1 to GMCS_M from the timing controller 200 through the single transmission line STL. The input circuit 510 may also output the received gamma control signals GMCS_1 to GMCS_M through multiple transmission lines MTL. For example, the input circuit 510 may output a first gamma control signal GMCS_1 to an M-th gamma control signal GMCS_M through the multiple transmission lines MTL, accordingly.

In other words, the input circuit 510 may output the gamma control signals GMCS_1 to GMCS_M, as received in a serial manner from the timing controller 200, through the single transmission line STL to the multiple transmission lines MTL, in a parallel manner.

The input circuit 510 may also include a voltage size converter or level shifter. According to an example, the input circuit 510 may convert voltage levels of the respective gamma control signals GMCS_1 to GMCS_M transmitted from the timing controller 200, and may output the resulting voltage levels. For example, the input circuit 510 may convert voltage levels of the respective gamma control signals GMCS_1 to GMCS_M into voltage levels capable of being used in the gamma correction circuit 500, thus facilitating the actual use of the respective gamma control signals GMCS_1 to GMCS_M.

Meanwhile, the gamma control signals GMCS_1 to GMCS_M output from the input circuit 510 may vary only in voltage level, with respect to being capable of being used in the gamma correction circuit 500. In the present disclosure, the gamma control signals GMCS_1 to GMCS_M transmitted from the timing controller 200 are substantially identical to the gamma control signals GMCS_1 to GMCS_M output from the input circuit 510.

The voltage generator 520 may generate gamma voltages VGM by using the gamma control signals GMCS_1 to GMCS_M. According to an example, the voltage generator 520 may determine reference gamma voltages by using the gamma control signals GMCS_1 to GMCS_M, and may output gamma voltages VGM on the basis of the determined reference gamma voltages. For example, the voltage generator 520 may determine gamma tap points, on the basis of the gamma control signals GMCS_1 to GMCS_M, may generate gamma voltages VGM by using reference gamma voltages corresponding to the determined gamma tap points, and may output the generated gamma voltages VGM, accordingly.

The gamma correction circuit 500 according to an example may receive gamma control signals GMCS_1 to GMCS_M used for determining reference gamma voltages from the timing controller 200 through the signal transmission line STL, and thus signal routing and related circuit complexity between the timing controller 200 and the gamma correction circuit 500 may be simplified, allowing for a simpler circuit with similar functionality and capabilities.

Particularly, according to an example, a single transmission line is used for receiving gamma control signals regardless of a number, for example, M, of gamma tap points selected in a gamma curve, and thus signal routing does not become complicated or resource-intensive, even when a number of gamma tap points selected in a gamma curve increases.

Figure 4:
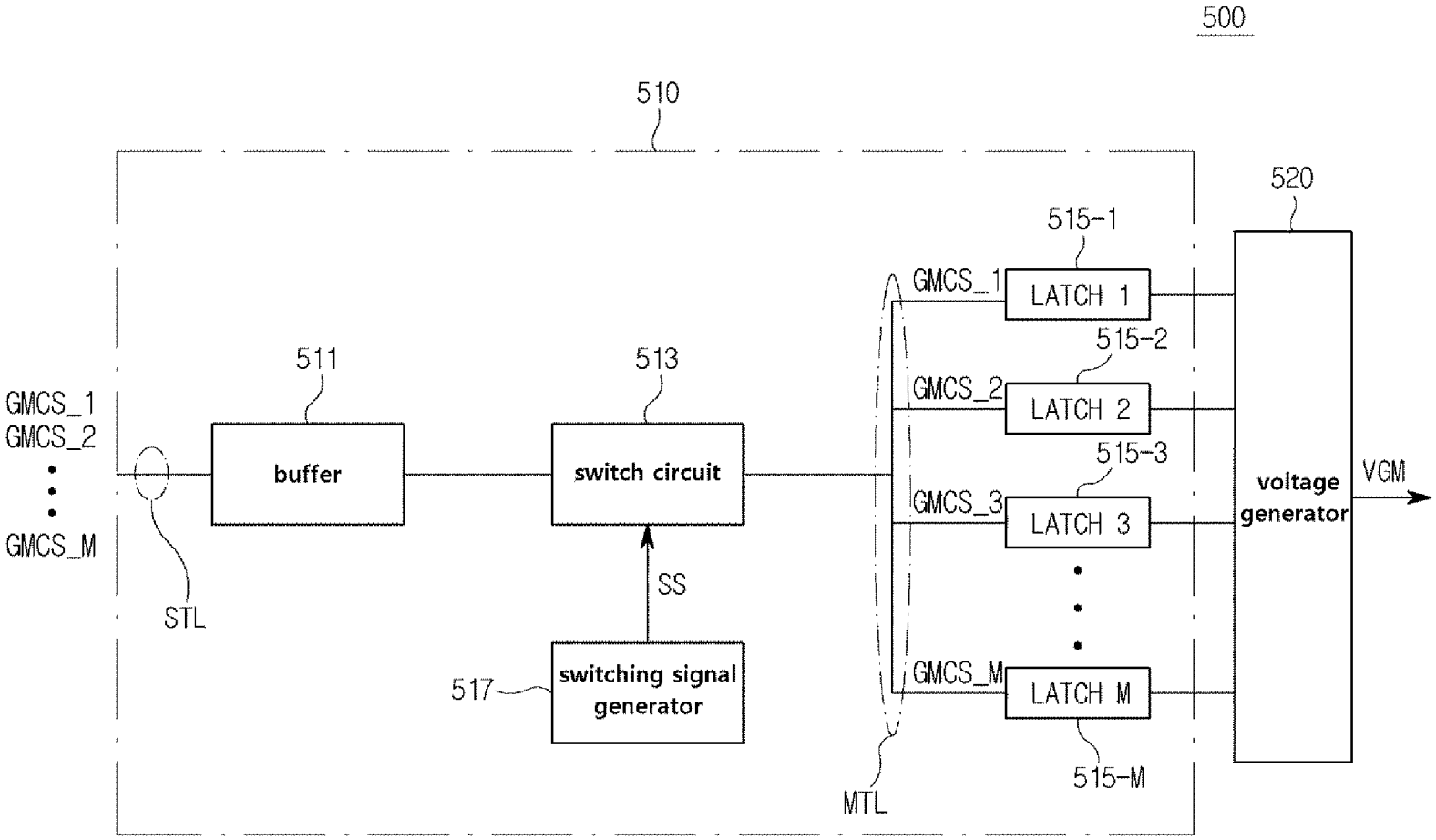
FIG. 4 is a view conceptually showing the gamma correction circuit according to an example.

FIG. 4 is a view showing a gamma correction circuit according to an example. Referring to the examples of FIGS. 1 to 4, the input circuit 510 may include a buffer 511, a switch circuit 513, latches 515-1 to 515-M, and a switching signal generator 517. However, this is a non-limiting example, and other examples may include other elements instead of or in addition to these enumerated examples.

The buffer 511 may receive gamma control signals GMCS_1 to GMCS_M and may output the received signals accordingly. According to an example, the buffer 511 may sequentially or continuously receive gamma control signals GMCS_1 to GMCS_M, and may sequentially output the received signals, accordingly. For example, the buffer 511 may output gamma control signals GMCS_1 to GMCS_M whenever the signals are received. In other words, the buffer 511 may receive a first gamma control signal GMCS_1 and may output the first gamma control signal GMCS_1, and may receive a second gamma control signal GMCS_2 and may output the second gamma control signal GMCS_2.

The buffer 511 may be employed in a voltage level converter, also referred to as a level shifter.

The switch circuit 513 may be used for outputting gamma control signals GMCS_1 to GMCS_M from the buffer 511 into the respective latches 515-1 to 515-M. According to an example, the switch circuit 513 may be used for transmitting the gamma control signals GMCS_1 to GMCS_M into the latches 515-1 to 515-M, through the multiple transmission lines MTL.

The gamma control signals GMCS_1 to GMCS_M may be sequentially output into the respective latches 515-1 to 515-M by the switch circuit 513, based on a switching operation. For example, by the operation of the switch circuit 513, a first gamma control signal GMCS_1 may be output into a first latch 515-1 by, and a second gamma control signal GMCS_2 may be output into a second latch 515-2. In such an example, output timings of the first gamma control signal GMCS_1 and the second gamma control signal GMCS_2 may be different from each other.

The switch circuit 513 may be used for outputting the gamma control signals GMCS_1 to GMCS_M into the respective latches 515-1 to 515-M in response to receiving a switching signal SS transmitted from the switching signal generator 517. For example, the switch circuit 513 may include at least one switch, in a non-limiting example.

The switching signal generator 517 may generate a switching signal SS used for controlling the switch circuit 513, in an example.

The latches 515-1 to 515-M may respectively output gamma control signals GMCS_1 to GMCS_M transmitted through the switch circuit 513 into the voltage generator 520 by latching the signals to retain the signals, as appropriate. According to examples, the latches 515-1 to 515-M may concurrently output the latched gamma control signals GMCS_1 to GMCS_M. In other words, even though receiving timings of gamma control signals GMCS_1 to GMCS_M in the latches 515-1 to 515-M may differ from each other, output timings of the gamma control signals GMCS_1 to GMCS_M from the latches 515-1 to 515-M may be identical, due to the latching.

According to an example, the latches 515-1 to 515-M may respectively output latched gamma control signals GMCS_1 to GMCS_M in response to a latch control signal.

The voltage generator 520 may receive gamma control signals GMCS_1 to GMCS_M output from the latches 515-1 to 515-M. The voltage generator 520 may output, as described above, gamma voltages VGM on the basis of the gamma control signals GMCS_1 to GMCS_M.

The gamma correction circuit 500 according to an example may receive gamma control signals GMCS_1 to GMCS_M used for generating gamma voltages VGM from the timing controller 200 through a single transmission line STL. As a result, a number of transmission lines between the timing controller 200 and the gamma correction circuit 500 may decrease, and thus signal routing may be simplified as a result.

Figure 5:
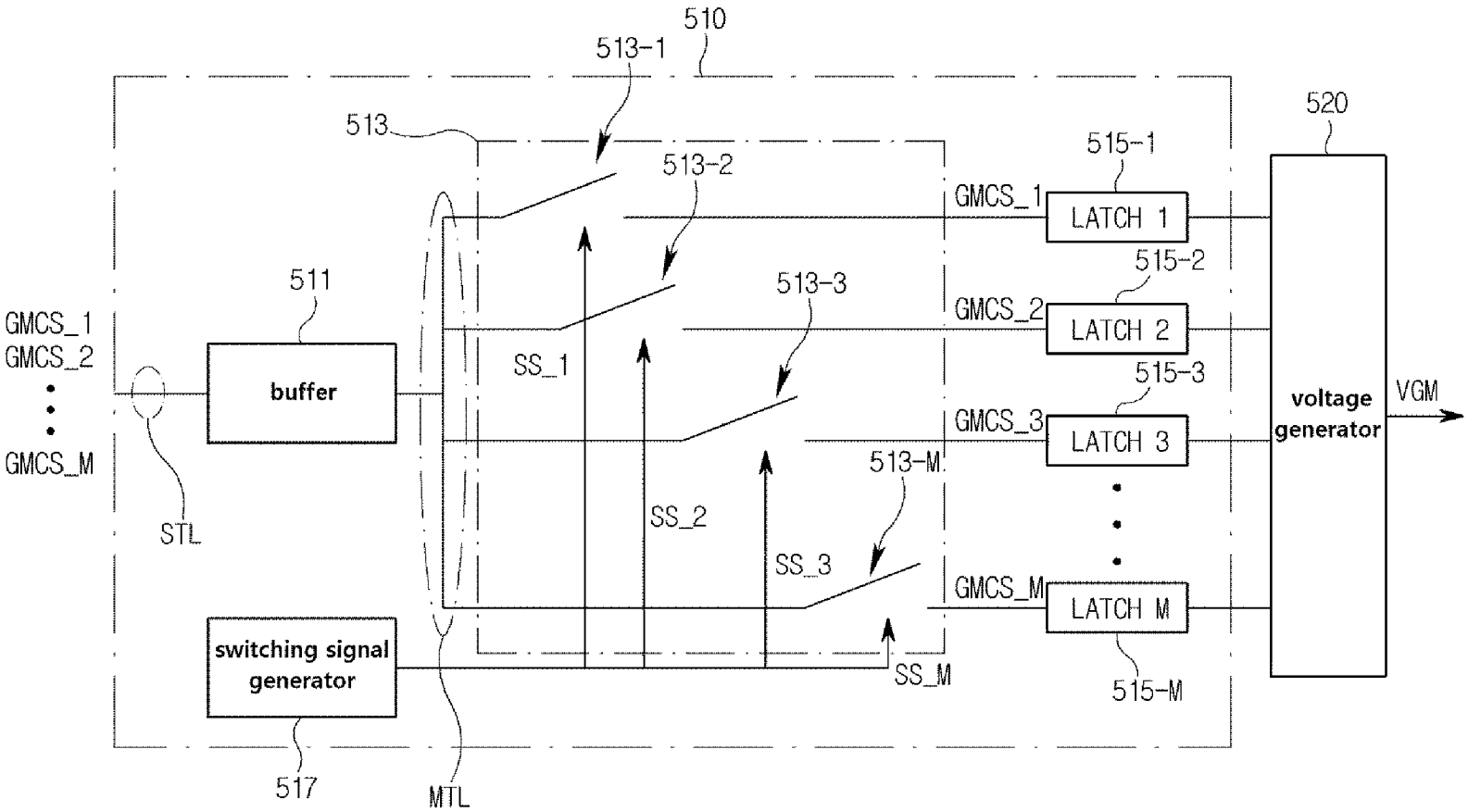
FIG. 5 is a view showing the gamma correction circuit according to an example.

FIG. 5 is a view showing the gamma correction circuit according to an example. Referring to the examples of FIGS. 1 to 5, the gamma correction circuit 500 of the example of FIG. 5 may include a switch circuit 513 including switches 513-1 to 513-M.

The switches 513-1 to 513-M may be turned on in response to switching signals SS_1 to SS_M so that gamma control signals GMCS_1 to GMCS_M may be output into the latches 515-1 to 515-M, for latching, as discussed in further detail, above. According to an example, a first gamma control signal GMCS_1 transmitted from the buffer 511 may be output to a first latch 515-1 by a first switch 513-1 in response to a first switching signal SS_1. Likewise, a second gamma control signal GMCS_2 transmitted from the buffer 511 may be output to a second latch 515-2 by a second switch 513-2 in response to a second switching signal SS_2.

According to a non-limiting example, switching timings, for example, turn-on timings, of the switches 513-1 to 513-M may be performed in order. For example, the second switch 513-2 may be turned on after the first switch 513-1 is turned on. In other words, output timings of switching signals SS_1 to SS_M may be in a sequential order. However, other orderings are possible, in other examples.

For example, switching signals SS_1 to SS_M used for operating the switches 513-1 to 513-M may be output by the switching signal generator 517.

According to an example, switching signals SS_1 to SS_M may be output by the switching signal generator 517, in response to receiving the output of gamma control signals GMCS_1 to GMCS_M from the timing controller 200. Output timings of the switching signals SS_1 to SS_M may be determined based on output timings of the gamma control signals GMCS_1 to GMCS_M.

Switching signals SS_1 to SS_M may be sequentially output by the switching signal generator 517. According to an example, the switching signal generator 517 may receive a reference switching signal, and output switching signals SS_1 to SS_M by sequentially delaying the reference switching signal. For example, such a reference switching signal may be transmitted from the timing controller 200, but the reference switching signal may also be generated and transmitted in other ways in other examples.

The gamma correction circuit 500 described with reference to the example of FIG. 4 and the gamma correction circuit 500 described with reference to the example of FIG. 5 may be identical in operation and configuration other than differing in configurations of the switch circuit 513 and the switching signal generator 517, and thus additional description of such examples is omitted, for brevity.

Figure 6:
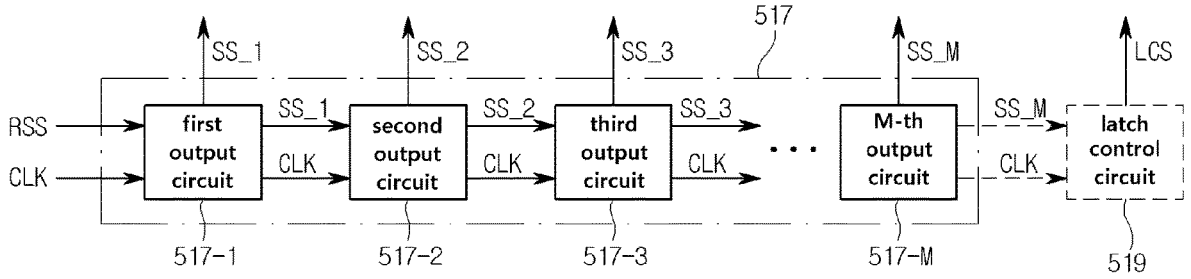
FIG. 6 is a view showing an input circuit according to an example.

FIG. 6 is a view showing the input circuit according to an example. Referring to the examples of FIGS. 1 to 6, the switching signal generator 517 may include output circuits 517-1 to 517-M.

The switching signal generator 517 may receive a reference switching signal RSS and a clock signal CLK. The switching signal generator 517 may output switching signals SS_1 to SS_M on the basis of the reference switching signal RSS and the clock signal CLK.

Several output circuits of the output circuits 517-1 to 517-M may output input signals without a delay. In other words, several output circuits of the output circuits 517-1 to 517-M may apply a delay to the input signals of 0.

A first output circuit 517-1 of the output circuits 517-1 to 517-M may have a delay value of 0. According to an example, the first output circuit 517-1 may output a first switching signal SS_1 by applying a delay to a reference switching signal RSS of 0. In other words, in such an example, the reference switching signal RSS and the first switching signal SS_1 may be identical in phase. In addition, according to an example, the first output circuit 517-1 may generate a voltage level of the reference switching signal RSS as a first switching signal SS_1. For example, the first output circuit 517-1 may be employed in a level shifter, as discussed in further detail, above.

Meanwhile, remaining output circuits 517-2 to 517-M may have respective positive delay values. According to an example, a second output circuit 517-2 may output a second switching signal SS_2 by applying a delay to the first switching signal SS_1. Likewise, a third output circuit 517-3 may output a third switching signal SS_3 by applying a delay to the second switching signal SS_2. Accordingly, operations of the remaining output circuits 517-3 to 517-M may be similar to the above specific examples. In other words, switching signals SS_2 to SS_M may respectively have sequentially delayed phases, in such a non-limiting example.

According to an example, the input circuit 510 may further include a latch control circuit 519 for generating a latch control signal LCS used for controlling outputs of the latches 515-1 to 515-M. For example, the latch control circuit 519 may generate a latch control signal LCS by using an M-th switching signal SS_M, for each of the latches 515-1 to 515-M.

According to an example, the latch control circuit 519 may generate a latch control signal LCS by applying a delay to an M-th switching signal SS_M.

As described above, the latches 515-1 to 515-M may respectively output gamma control signals GMCS_1 to GMCS_M in response to receiving a latch control signal LCS.

Figure 7:
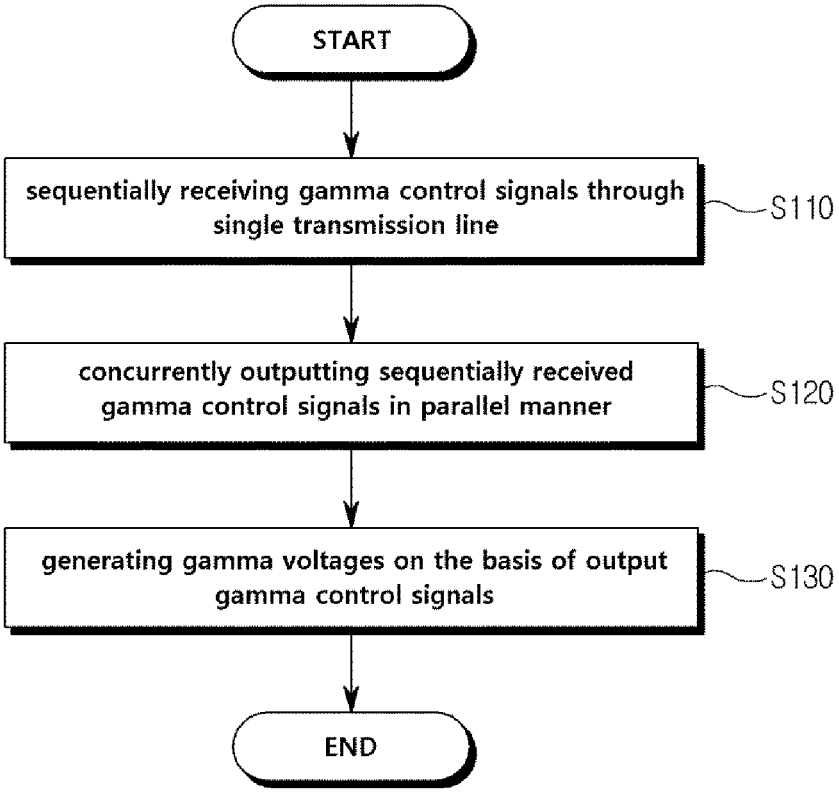
FIG. 7 is a view of a flowchart showing a gamma correction method according to an example.

FIG. 7 is a view of a flowchart showing a gamma correction method according to an example. The gamma correction method described with reference to the example of FIG. 7 may be performed by the gamma correction circuit 500 described with reference to the examples of FIGS. 1 to 6.

Referring to the examples of FIGS. 1 to 7, in operation S110, the gamma correction circuit 500 may sequentially receive gamma control signals GMCS_1 to GMCS_M used for selecting a plurality of gamma tap points through a single transmission line STL.

In operation S120, the gamma correction circuit 500 may concurrently output the sequentially received gamma control signals GMCS_1 to GMCS_M through lines differ in from each other, in a parallel manner. According to an example, the gamma correction circuit 500 may respectively perform latching for the sequentially received gamma control signals GMCS_1 to GMCS_M. In such an example, the gamma correction circuit 500 may concurrently output the latched control signals in a parallel manner.

According to an example, the gamma correction circuit 500 may perform latching for the sequentially received gamma control signals GMCS_1 to GMCS_M according to timings that differ from each other, and may concurrently output the latched control signals in a parallel manner. Accordingly, output timings of the gamma control signals GMCS_1 to GMCS_M may be identical to one another even though original input timings of the gamma control signals GMCS_1 to GMCS_M may be different from one another.

In operation S130, the gamma correction circuit 500 may generate gamma voltages on the basis of the output gamma control signals.

Figure 8:
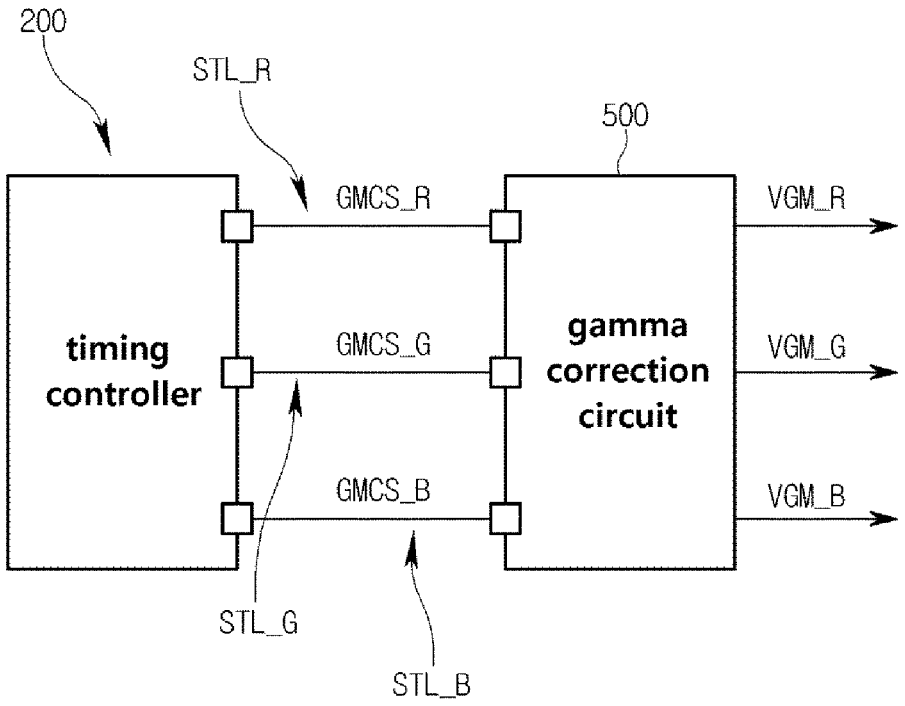
FIG. 8 is a view showing the timing controller and the gamma correction circuit according to an example.

FIG. 8 is a view showing the timing controller and the gamma correction circuit according to an example. Differing from the example of FIG. 3, the gamma correction circuit 500 of FIG. 8 may receive gamma control signals GMCS_R, GMCS_G, and GMCS_B in association with R, G and B pixel data. Such pixel-based gamma control signals GMCS_R, GMCS_G and GMCS_B may represent gamma features or gamma curves, as applied to respective pixel types.

The gamma correction circuit 500 may generate separate R pixel gamma voltages VGM_R used for gamma correction of R pixel data, G pixel gamma voltages VGM_G used for gamma correction of G pixel data, and B pixel gamma voltages VGM_B used for gamma correction of B pixel data.

According to the example of FIG. 8, the gamma correction circuit 500 and the timing controller 200 may be connected through three single transmission lines STL. According to an example, the gamma correction circuit 500 may be connected to timing controller 200 through an R pixel single transmission line STL_R, a G pixel single transmission line STL_G, and a B pixel single transmission line STL_B, and thus each type of color data is transmitted through a particular, designated single transmission line.

The gamma correction circuit 500 may sequentially receive R pixel control signals GMCS_R through the R pixel single transmission line STL_R, G pixel control signals GMCS_G through the G pixel single transmission line STL_G, and B pixel control signals GMCS_B through the B pixel single transmission line STL_B. For example, when each of R pixel gamma control signals GMCS_R is a signal of N bits, the R pixel gamma control signals GMCS_R may be then be sequentially transmitted to the gamma correction circuit 500 through the R pixel single transmission line STL_R one by one, as N bit units. In other words, data may be sequentially transmitted on the basis of N-bit units through the single transmission line STL one by one, as N bit units.

The gamma correction circuit 500 may generate gamma voltages VGM_R, VGM_G and VGM_B for each of R, G and B pixels by using the R, G and B pixel gamma control signals GMCS_R, GMCS_G and GMCS_B, according to the example of FIG. 8. According to an example, numbers of respective R, G and B pixel gamma control signals GMCS_R, GMCS_G and GMCS_B may thus be respectively identical to number of R, G and B pixel gamma tap points.

According to an example, the gamma correction circuit 500 may determine gamma tap points for respective R, G and B pixels by using R, G and B pixel gamma control signals GMCS_R, GMCS_G and GMCS_B, and may generate gamma voltages VGM_R, VGM_G and VGM_B for the respective R, G and B pixels that correspond to the determined gamma tap points by using such reference gamma voltages.

The display device 10, display panel 100, timing controller 200, gate driving circuit 300, display driving circuit 400, drivers 410-1, 410-2, . . . , decoders 411-1, 411-2, . . . , source amplifiers 413-1, 413-2, . . . , input circuit 510, voltage generator 520, buffer 511, switch circuit 513, switches 513-1 to 513-M, latches 515-1 to 515-M, switching signal generator 517, output circuits 517-1 to 517-M, and latch control circuit 519 in FIGS. 1-8 that perform the operations described in this application are implemented by hardware components configured to perform the operations described in this application that are performed by the hardware components. Examples of hardware components that may be used to perform the operations described in this application where appropriate include buffers, transistors, controllers, sensors, generators, drivers, memories, comparators, arithmetic logic units, adders, subtractors, multipliers, dividers, integrators, and any other electronic components configured to perform the operations described in this application.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A gamma correction circuit, comprising:

an input circuit configured to sequentially receive gamma control signals used for selecting gamma tap points from a control circuit through a designated single transmission line for each type of color data, and to output the received gamma control signals, the input circuit comprising:

a voltage level shifter configured to convert voltage levels of the gamma control signals transmitted through the designated single transmission line for each type of color data, and a switch circuit configured to sequentially output the gamma control signals from the voltage level shifter into latches through multiple transmission lines; and a voltage generator configured to select the gamma tap points based on the gamma control signals, and to generate gamma voltages according to the gamma tap points.

2. The gamma correction circuit of claim 1, wherein the latches are configured to respectively latch the gamma control signals, and to concurrently output the latched gamma control signals into the voltage generator.

3. The gamma correction circuit of claim 2, wherein the switch circuit comprises switches, and wherein the switches are turned on in response to receiving switching signals, so that the gamma control signals received in the voltage level shifter are output, respectively, by the latches.

4. The gamma correction circuit of claim 3, wherein the input circuit further comprises a switching signal generator configured to generate the switching signals for turning on the switches, and to sequentially transmit the switching signals into the respective switches.

5. The gamma correction circuit of claim 4, wherein the switching signal generator comprises output circuits configured to sequentially output the switching signals, and wherein at least one of the output circuits is used by a level shifter.

6. The gamma correction circuit of claim 2, wherein the latches are configured to respectively output the latched gamma control signals, in a parallel manner, to the voltage generator in response to receiving a latch control signal.

7. The gamma correction circuit of claim 1, wherein the voltage generator is configured to select the gamma tap points that become references of the gamma correction based on the gamma control signals, to determine reference gamma voltages for the respective gamma tap points, and to generate the gamma voltages by using the reference gamma voltages.

8. The gamma correction circuit of claim 7, wherein the voltage generator comprises a resistor string comprising nodes corresponding to the respective gamma tap points, and is configured to generate the gamma voltages by using voltages output from the respective nodes for the respective reference gamma voltages.

9. The gamma correction circuit of claim 8, wherein the voltage generator is configured to determine positions of the respective nodes in the resistor string by using the received gamma control signals, and to generate the gamma voltages by using reference gamma voltages output from the respective determined nodes.

10. A gamma correction circuit, comprising:

an input circuit configured to sequentially receive M gamma control signals used for selecting M gamma tap points from a control circuit through a single transmission line, M being a natural number equal to or greater than 2, and to respectively output the M gamma control signals through M transmission lines, the input circuit comprising:

a voltage level shifter configured to convert voltage levels of the M gamma control signals transmitted through the single transmission line, and a switch circuit configured to sequentially output the M gamma control signals from the voltage level shifter into M latches through the M transmission lines; and a voltage generator configured to generate gamma voltages on the basis of the M gamma control signals.

11. The gamma correction circuit of claim 10, wherein the M latches are configured to respectively latch the M gamma control signals, and to concurrently output the latched M gamma control signals into the voltage generator.

12. The gamma correction circuit of claim 11, wherein the switch circuit comprises M switches respectively connected to the M latches, and wherein the respective M switches are configured to be turned on in response to switching signals so that the M gamma control signals received in the voltage level shifter are output into the respective M latches.

13. The gamma correction circuit of claim 11, wherein the M latches are configured to respectively output the M latched gamma control signals in a parallel manner into the voltage generator, in response to receiving a latch control signal.

14. The gamma correction circuit of claim 10, wherein the voltage generator is configured to select the M gamma tap points that become references of the gamma correction based on the M gamma control signals, to determine M reference gamma voltages for the M gamma tap points, and to generate the gamma voltages by using the M reference gamma voltages.

15. A gamma correction method, the method comprising:

sequentially receiving, by an input circuit, gamma control signals used for selecting gamma tap points through a designated single transmission line for each type of color data;

concurrently outputting, by the input circuit in a parallel manner, the sequentially received gamma control signals through multiple transmission lines differing from each other; and generating gamma voltages on the basis of the outputted gamma control signals, wherein the input circuit comprises:

a voltage level shifter configured to convert voltage levels of the gamma control signals transmitted through the designated single transmission line for each type of color data, and a switch circuit configured to sequentially output the gamma control signals from the voltage level shifter into latches through the multiple transmission lines.

16. The method of claim 15, wherein the outputting in a parallel manner of the sequentially received gamma control signals comprises:

respectively latching the sequentially received gamma control signals; and concurrently outputting, in a parallel manner, the latched gamma control signals.

17. The method of claim 15, wherein receiving timings of the respective gamma control signals are different from each other, and output timings of the respective gamma control signals are identical to each other.

* * * * *